United States Patent [19]

Ahrweiler et al.

[11] Patent Number: 4,534,829

[45] Date of Patent: Aug. 13, 1985

[54] CALENDER

[75] Inventors: Karl-Heinz Ahrweiler, Willich; Helmut Anstötz, Tönisvorst; Werner Hartmann, Krefeld, all of Fed. Rep. of Germany

[73] Assignee: Eduard Küsters, Krefeld-Forstwald, Fed. Rep. of Germany

[21] Appl. No.: 459,198

[22] Filed: Jan. 19, 1983

[30] Foreign Application Priority Data

Jan. 20, 1982 [DE] Fed. Rep. of Germany ..... 3201635

[51] Int. Cl.[3] ..... D21G 1/00

[52] U.S. Cl. ..... 162/361; 100/161; 100/169; 100/176; 100/170; 162/360.1; 162/206

[58] Field of Search ..... 162/361, 360, 206; 100/38, 93 RP, 161, 168, 169, 170, 176

[56] References Cited

U.S. PATENT DOCUMENTS

| | | | |
|---|---|---|---|
| 3,757,398 | 9/1973 | Urban | 29/113 AD |
| 3,759,785 | 9/1973 | Mihelich | 162/206 |
| 3,779,051 | 12/1973 | Kuesters | 100/176 X |
| 3,841,963 | 10/1974 | Schlunke | 100/161 |
| 4,089,094 | 5/1978 | Kaira | 29/116 AD |
| 4,158,594 | 6/1979 | Becker et al. | 162/112 |
| 4,194,446 | 3/1980 | Palovaara | 29/116 AD |
| 4,230,036 | 10/1980 | Groome | 100/176 X |
| 4,257,843 | 3/1981 | Watanabe et al. | 162/206 X |
| 4,324,177 | 4/1982 | Tsuji et al. | 29/132 |

FOREIGN PATENT DOCUMENTS

| | | | |
|---|---|---|---|
| 27621 | 4/1981 | European Pat. Off. . | |
| 1206609 | 3/1958 | Fed. Rep. of Germany . | |
| 2844051 | 1/1982 | Fed. Rep. of Germany . | |
| 3201635 | 2/1984 | Fed. Rep. of Germany . | |
| 1339801 | 9/1963 | France . | |
| 960933 | 6/1964 | United Kingdom | 162/206 |
| 2031115 | 4/1980 | United Kingdom | 100/176 |

OTHER PUBLICATIONS

E. Munch, J. Schlunke and W. Schmitz; "Verfahren und Maschinen zur Erzugung von Glatte und Glanz im-in-line-Prozess-Entwicklung und Modernster," Wochenblatt for Papierfabrikation; (1978), pp. 809-814.

W. G. Stotz, "New Solutions in Calender Design", Escher Wyss, (7/1981), pp. 1-5.

*Primary Examiner*—S. Leon Bashore
*Assistant Examiner*—K. M. Hastings
*Attorney, Agent, or Firm*—Kenyon & Kenyon

[57] ABSTRACT

A supercalender at the output of a paper machine includes two pairs of zone-wise deflection-controlled rollers. Each pair has a hard surface roller and a soft roller with an elastic outer layer or covering having a minimum hardness of 85° Shore D. The hard rollers are disposed on one side and the soft rollers on the other side of the travel path of the paper.

8 Claims, 1 Drawing Figure

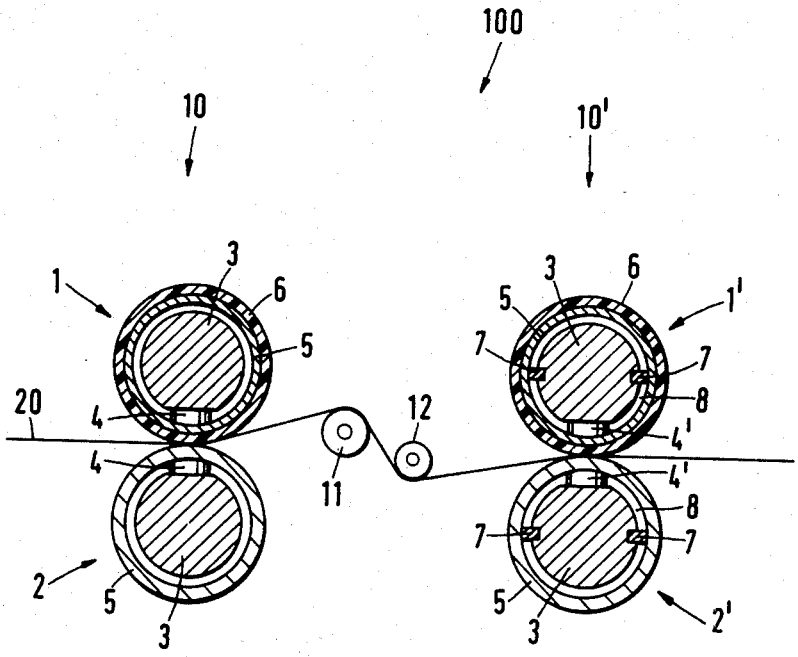
100
10
10'
1
1'
2
2'
3
4
4'
5
6
7
8
11
12
20

CALENDER

BACKGROUND OF THE INVENTION

This invention relates to a supercalender to be installed at the output of a paper producing machine in an "in-line" arrangement.

Paper appearing at the output of a paper machine has, in a raw condition, a relatively rough surface and requires for most applications further processing which results in a leveling and a compression of the surface. The additional processing is generally accomplished by calenders and supercalenders. Calenders comprise only hard rollers and level the peripheral surfaces of the paper so that the parts of the paper forming the outer surface lie essentially in one plane.

The roller gaps or nips of a supercalender are so called soft roller gaps, i.e., those in which a hard roller is paired with an elastically yielding roller. Elastic rollers in supercalenders are usually in the form of paper rollers, i.e., drums made of layers of paper sheets. Calenders compress the paper web and close pores in the web's outer surface, thereby smoothing and lending luster to the paper.

Supercalenders generally comprise a vertically arrayed stack of rollers which are alternately hard and soft. In such a supercalender the paper web runs through a succession of roller nips.

The currently predominant practice involves the processing of the paper surface at a separate work station downstream of, i.e., at the output of, the paper producing machine. The paper web is rolled up at the output of the paper machine, subsequently unwound in a separate work stage, surface processed and then again rolled up. In most cases two supercalenders are necessary to handle the production of a paper machine, which at elevated working speeds can produce up to 1000 meters of paper per minute, because disturbances during processing of the paper surface frequently result in a shut down of the operating supercalender. A single supercalender is thus insufficient to keep up with the production of a fast paper machine.

The separate processing of the paper surface in a so-called "off line" assembly is disadvantageous owing to the necessity of additional winding stages. The ideal circumstance is to have the paper pass through the surface processing stations in a continuous train at the output of the paper producing machine, the paper being continuously produced in its final state at the end of the processing steps.

It has been known for a long time to integrate calenders into the paper machines for smoothing the surface of the paper web. The effects achieved with calenders are, however, satisfactory only for certain applications and are undesirable for other applications, for example, because dark spots can arise in the paper surface owing to locally varying compression of the paper fibers.

The integration of supercalenders into paper machines has been undertaken to date only in isolated cases for special purposes. In addition to the difficulties the entire installation would suffer upon a breakdown or malfunction in a supercalender integrated into the paper machine, there is the problem that the yielding or flexible rollers would not be able to withstand the stresses which are produced at high speeds in the faster paper machines.

An example of a supercalender integrated into a paper machine is described in the German language magazine "Wochenblatt fur Papierfabrication" ("Weekly Paper for Paper Making"), Volume 21, 1978, pages 809–814, and in particular page 814. This so-called glazing supercalender comprises a stack of five rollers, of which three are hard and two soft. The paper web passes through four roller nips. In order to achieve the desired effect, relatively high pressures are required. The use of such pressures has frequently resulted in the deformation into polygonal shapes of the outer layers of relatively soft rollers, which deformation leads, during machine operation, to vibrations which are difficult to control. Moreover, in the familiar form of implementation it is problematic that the soft rollers each function at two roller nips and thus experience two milling operations during each rotation. The concomitant transfer of milling work into heat leads to an increase in temperature of the coverings of the elastic rollers, and the existence of a maximum allowable temperature means a limit on the working speed of the supercalender. The familiar glazing calendar has a maximum speed of 250 m/min.

This disadvantage is not present in the supercalender described in European patent application (EUOS) No. 27,621 published Apr. 29, 1981 "in line" utilization. This supercalender comprises at least two cofunctioning hard rollers, against which a total of four soft rollers press from the side. The paper web meanders through the roller assembly and alternately traverses soft roller nips and hard roller nips. Further hard rollers can be placed from the outside against the first two rollers in the same plane, so that the number of the hard roller nips can be increased. The soft rollers are supposed to be paper rollers, i.e., made of paper layers, whereby the calendar is suitable only for paper machines of low speed. In addition, because the rollers do not lie in a single plane, adjusting the rollers is very expensive and stable operation of the assembly is not easy.

An object of the present invention is to provide a supercalender for in-line operation, which is of simple construction and which enables the use of higher speeds than possible with conventional supercalenders.

SUMMARY OF THE INVENTION

A supercalender in accordance with the present invention comprises two pairs of glazing rollers, one pair disposed behind the other along a travel path of the paper web. The simple construction results not only in decreased assembly cost but also in easier operation and increased reliability. The initial drawing of the paper web through the supercalender is facilitated, while the danger of disturbances or malfunctions is reduced. Although strictly speaking, a supercalender is a stack of alternate chilled cast-iron and soft rollers, that term is used herein to describe the pairs of rollers of the present invention, which are not necessarily stacked, because these pairs are each made up of a hard roller and soft roller.

An increase in working speed is achieved by the requirement that the elastic shells or coverings of the soft rollers have a predetermined minimum hardness, whereby the production of heat in the coverings can be kept to a relatively low level. This minimum hardness is substantially greater than the hardness grades traditionally employed in soft supercalender rollers. The hardest soft roller coverings have been made of layered material impregnated with synthetic resin and having a maximum hardness of 80° to 82° Shore D. It might have been expected that there would be a tendency towards a greasiness of the paper in using soft rollers with a high hardness, because processing with such soft rollers approaches hard roller processing. However, no greasiness or other disadvantage of hard roller processing has appeared. Use of soft rollers having a hardness in accordance with the invention results in a mixed effect between part smoothing, which is produced with parts of hard rollers, and glazing effects, which are attainable in conventional supercalenders by means of paper rollers. Such a mixed or intermediate result has proved advantageous for many applications and can be attained neither through reeling mills of conventional construction nor through traditional supercalenders.

The provision of two pairs of rollers is advantageous in that the roller with the elastic covering works only at a roller nip and the milling work, which is already descreased, occurs only once per cycle. In addition the linear pressure at a single roller nip, which pressure is necessary to reaching a processing effect which is satisfactory overall, can be lowered. The rollers are in a sense doubly relieved or unburdened through the provision of two spaced roller pairs, this unloading facilitating the increase of the possible working speed to heightened values.

The relative hardness of the elastic rollers means, however, that they are especially sensitive to unequal distribution of the linear pressure. With pressure differences along the length of the roller gap, the processing effect transverse to the path of the paper is highly variable, so that much depends on holding the pressure as even as possible over the breadth of the paper web. To achieve this end, it is necessary to employ zone-wise deflection-controllable rollers. These are rollers which have hollow roller shells rotating about stationary cores, and in which the linear pressure is adjusted along the length of the hollow roller shell by means of pistons mounted on the core and driven into engagement with the inner surface of the roller shell. The linear pressure at the roller slot can be produced entirely by means of the pistons, as described in U.S. Pat. No. 3,802,044. The alternative is to have rollers as described in U.S. Pat. No. 4,307,501 in which longitudinal chambers are created between the roller core and the shell by means of longitudinal seals, the chamber facing the roller slot being filled with a pressurizable fluid such as oil. In this case the pistons relieve, in selectable zones of the roller shell, the otherwise equal pressure on the inner periphery of the shell. In both cases the pressure along the roller gap can be influenced to a certain extent as desired through proper control.

This is not the case with the so-called S rollers described in German patent document (Deutsche Patentshrift) No. 1,026,609 first published Mar. 20, 1958 in which only a uniform deflection, or a corresponding linear pressure gradient, can be attained over the entire roller length. The same holds true, of course, for every massive roller.

The totality of the features of the present invention results in practice in an apparatus employable in many circumstances and producing, in many applications, surprising advantages and processing effects.

There are processes, in particular in the manufacture of uniformly coated paper, in which it is advantageous to have the hard roller and the soft covered roller of a roller pair engage different sides of the paper web.

In accordance with a feature of the present invention, the elastic rollers of the two roller pairs are disposed on one side of the paper web, while the hard rollers are on the other side of the web. An advantage of this arrangement is that the desired processing effect is reached in two steps and in each step a lower pressure can be used, which results in a treatment of the paper web.

The preferred hardness range for the covering of the elastic roller is 85° to 90° Shore D. This hardness can be attained through a covering made of hard rubber, in which the filling material is correspondingly high. Paper rollers are ineffective to reach such hardness levels. It is likewise difficult to reach such hardness levels with plastics, although plastics can produce the desired processing effects and can tolerate high speeds at the required pressures.

It is advantageous if the covering of the elastic roller has a thickness of at least 15 mm. It is possible that the large thickness, producing a certain elasticity in the covering, partially compensates the high hardness of the covering and that the result is achieved through coaction of the two features.

BRIEF DESCRIPTION OF THE DRAWING

The single FIGURE is a cross-sectional view of a supercalender having two pairs of rollers in accordance with the present invention.

DETAILED DESCRIPTION

A supercalender 100 according to the present invention comprises two roller pairs 10 and 10' spaced from one another along a path of travel of a paper web 20. Roller pair 10 in turn comprises rollers 1 and 2 which are zone-wise deflection-controllable.

Each roller 1 and 2 includes a stationary core or shaft 3, about which a hollow roller or shell 5 is rotatably mounted and which is itself mounted on a machine stand or framework (not shown) at roller core ends (not shown) which project from shells 5. The upper roller 1 of pair 10 has an elastic covering 6 made of hard rubber having a hardness in the range 85° to 90° Shore D, preferably 88° Shore D, while the hard outer surface of steel shell 5 of the lower roller 2 serves as the working surface thereof. The working pressure is produced along the length of core 3 (in both rollers 1 and 2) by means of hydraulically driven pressure pistons 4, which engage the inner surface of shell 5 and glide therealong. The pressure exerted via each piston 4 in a roller 1 or 2 is variable independently of the other pistons. Thus the linear pressure along the length of the roller slot can be varied as desired.

The counter forces to those exerted by the pressure pistons 4 arise through deflection of the stationary core 3. The roller shell or sleeve 5 of each roller 1 and 2 is separated from the core so that the core can bend inside the shell without touching it.

The rollers 1 and 2 normally have dimensions of 4 to 5 m in length and 400 to 500 mm in diameter with elastic covering 6 having a thickness of 6 to 20 mm. Preferably, the elastic covering has a thickness of at least 15 mm.

Rollers 1' and 2' of roller pair 10' have the same structural components as rollers 1 and 2, as well as longitudinal seals 7 mounted in core 3 and engaging the inner surface of shell 5. Seals 7, the respective core 3 and shell 5, together with a pair of annular seals (not illustrated) lying in respective planes at the ends of each roller 1' and 2' between the core and the shell, form a longitudinal chamber 8 facing the roller gap or nip. The chambers 8 of rollers 1' and 2' are filled with oil via conduits extending from a pressure source. The oil is pressurized to exert a uniform pressure over the entire length of the roller nip. Pistons 4' of rollers 1' and 2' are operable to decrease the pressure in selected regions of the roller shells 5, whereby the pressure profile along the roller nip is adjustable. Thus, while pressure pistons of rollers 1 and 2 produce or increase pressure at the roller slot, pistons 4' reduce pressure at the nip.

The difference between roller pairs 10 and 10' serve only to illustrate the different possibilities. Normally roller pairs 10 and 10' will be identical in the internal structures of their component rollers 1 and 2 and 1' and 2'.

The disposition of rollers 1 and 2 relative to the paper web 20 is the same as the disposition of rollers 1' and 2'. That is, in both roller pairs, the roller 1 or 1' with the elastic covering 6 engages the upper side of the paper web 20. Roller pairs 10 and 10' can also be arranged so that the paper web passes in a vertical direction through the roller nips of successive roller pairs.

Between roller pairs 10 and 10' is provided a rotary stretcher 11 as well as a roller 12 for measuring and controlling the tension of paper web 20.

Paper web 20 emerges from the paper machine and immediately enters into supercalender 100 and is subjected by roller pairs 10 and 10' to a two stage smoothing and glazing treatment.

EXPERIMENT EXAMPLE 1

Self-duplicating paper consists of sets of 3 different sheets of papers:

(1) a paper sheet which is provided with a so-called f-coating in a paper machine having a coating apparatus with a coating band or strip, the f-coating serving to extract or convey the reception of the duplicated character;

(2) a paper sheet which is prepared as raw paper in the paper machine and thereafter is coated in a separate coating machine with a b-coating, which contains the color pellets producing the duplicated characters; and (3) a paper sheet which is coated in the paper machine with an f-coating and in the coating machine with a b-coating.

The first paper sheet, i.e., the sheet bearing an f-coating only, is the bottom sheet of a self-duplicating set and has its coated side turned upwards. The second paper sheet, i.e., the sheet bearing a b-coating only, is the upper sheet of the set and has its coated side facing downwards. The third sheet, i.e., the one with both a b-coating and an f-coating, is the middle sheet, whereby the side bearing the color pellet or b-coating faces the f-coating of the bottom sheet.

A gloss of more than 35 Bekk sec. (a measurement of smoothness) is aimed for in the bottom or f-coated sheets. A gloss of 50 Bekk sec. is aimed for in the middle or doubly coated sheets, since the gloss falls in quality owing to the second coating (i.e., owing to a new dampening).

Which side of the paper is to have the predetermined gloss value is irrelevant, because after processing of paper web 20 in supercalender 100 both sides of the web have substantially the same glossiness. The paper web 20 reaches the supercalender with the porous side facing downwards. This side carries the f-coating and engages the hard roller 2 (and 2'). It is possible that a certain gloss equalization is achieved here.

Extensive executed experiments have shown that glosses up to 50 Bekk sec. can be produced without difficulty in the supercalender 100 according to the present invention. The pressure required to achieve these glosses has been decreased by more than 50% by using supercalender 100. Moreover, the smoothness profile in the transverse direction is good and the paper is not greasy. Moisture content varies between 6.3 and 6.8%. The paper machine and supercalender 100 can handle up to 600 meters of paper per minute.

It is to be noted that glosses produced by a supercalender in accordance with this invention deteriorated in quality, upon storage as well as upon a subsequent line coating, to a significantly lesser extent than glosses produced with a conventional supercalender. The reason for this result is unknown.

EXPERIMENT EXAMPLE 2

Dull or mat paper and bank post paper have gloss values of 15 Bekk sec. which are producable on supercalender 100 with fewer difficulties than in a calender with hard cast rollers. This is true also for photocopy paper, which has a gloss value of 25 Bekk sec.

EXPERIMENT EXAMPLE 3

Optical document and voucher paper with a basis weight of 90 g/m$^2$ have gloss values of more than 30 Bekk sec., which owing to the maculate surface of the papers has been attainable until now only in conventional supercalenders. This paper is processable in supercalender 100, wherein the pressure in roller pairs 10 and 10' are 50 and 60 daN/cm, respectively. The resulting paper has a perfect quality.

What is claimed is:

1. A supercalender for in-line employment at a paper machine, comprising:

a first pair of zone-wise deflection-controlled rollers forming a first roller nip;

a second pair of zone-wise deflection-controlled rollers forming a second roller nip, said second pair being closely spaced from said first pair along a paper travel path extending from the output of the paper machine; and each of said pairs including a hard roller and a soft roller with an elastic covering having a hardness of at least 85° Shore D, and a thickness of at least fifteen millimeters.

2. The supercalender defined in claim 1 wherein the hard rollers of said pairs are disposed on the same side of said path.

3. The supercalender defined in claim 2 wherein said elastic coverings have a hardness in the range 85° to 90° Shore D.

4. The supercalender defined in 3 wherein said coverings are made of hard rubber.

5. In a supercalender for in-line operation with a paper machine the improvement comprising:

the supercalender comprising two pairs of zone-wise deflection-controlled rollers, each pair including a hard roller and a soft roller, said soft roller bearing an elastic covering having a hardness of at least 85° Shore D, and a thickness of at least fifteen millimeters, said pairs being spaced from one another along a path of travel of a paper web.

6. The improvement defined in claim 5 wherein the rollers of said pairs bearing said covering are disposed on the same side of said path.

7. The improvement defined in claim 5 wherein said coverings are made of hard rubber.

8. The improvement defined in claim 5 wherein said coverings have a hardness of 85° to 90° Shore D.

* * * * *